United States Patent [19]

Crane

[11] Patent Number: 4,731,614

[45] Date of Patent: Mar. 15, 1988

[54] PHASED ARRAY SCANNING SYSTEM

[76] Inventor: Patrick E. Crane, 13706 Chestersall Dr., Tampa, Fla. 33624

[21] Appl. No.: 895,421

[22] Filed: Aug. 11, 1986

[51] Int. Cl.[4] ..... H01Q 3/26; H01Q 3/00

[52] U.S. Cl. ..... 342/372; 343/757

[58] Field of Search ..... 342/368–374, 342/157, 158; 343/757, 700 MS

[56] References Cited

U.S. PATENT DOCUMENTS 3,307,188 2/1967 Marchetti et al. ..... 342/372

4,490,721 12/1984 Stockton et al. ..... 342/368

*Primary Examiner*—Theodore M. Blum

*Assistant Examiner*—Gregory C. Issing

*Attorney, Agent, or Firm*—James Creighton Wray

[57] ABSTRACT

In an electronically scanned phased array capable of operating at millimeter wavelength frequencies, phase control is implemented through the superposition of orthogonal phase functions via a distributed mixing process at IF frequencies. When the elements of the array are replaced by mixers, and the distribution network operated at LO and IF frequencies, the number of phase shifters required is reduced from M×N to M+N and lower frequency technology is used.

13 Claims, 3 Drawing Figures

PHASED ARRAY SCANNING SYSTEM

BACKGROUND OF THE INVENTION

Phased arrays can be designed to form multiple beams in space and to perform rapid complex or simple scanning of these beams, and provide adaptive capabilities for electronic counter measure purposes.

One of the inviolable laws in the design of electronically scanned phased arrays, defines the relationship between gain-scan volume and the required number of phase controls. This law, referred to as Stangel's Theorem (presented 1974 URSI Spring Meeting Digest), defines "M", the number of phase control elements required and is expressed below in heuristic terms to make a point.

$$\frac{1}{4\pi}\ \phi G(\theta,\phi)d\theta d\phi$$

defines M, where M equals the required number of phase shifters.

This relationship states that in order to achieve a given gain over a specified scan volume, "M" phase control elements are required. One can see that an increase in the required gain (read aperture size) and/or the scan volume, necessitates an increase in the number of phase control elements.

While electronically scanned phased arrays have been in use for years at UHF and microwave frequencies, they have been employed in special applications where these arrays were the only viable means of satisfying the antenna requirements. Phase control technology has matured sufficiently at these lower frequencies to permit their use in large arrays.

At millimeter wavelength frequencies, the difficulty of obtaining and using phase control devices is far greater. One known practical means of phase control is ferrite devices. These devices become very expensive at frequencies above 26 GHz and are not amenable to true mass production, causing prices to remain high even in production. In addition, existing ferrite technology provides acceptable performance only to about 60 GHz, and the devices are dimensionally incompatible with the element packing densities required at millimeter wave frequencies. There are other known means (e.g., diode phase shifters) of obtaining control, but these are much too lossy for application at millimeter frequencies unless active apertures are utilized in a manner which provides for establishment of system noise figure independent of the high phase shifter losses. This active aperture technology is being pursued by multiple aerospace firms, currently.

For antenna apertures of appreciable size, the number of required phase shifters can easily be in the thousands. As a result, electronically scanned phased arrays employing ferrite technology become cost prohibitive.

It is known that phase is preserved in the heterodyne process. It has been previously suggested as a scanning technique for single plane scanning.

It is also known that single diodes can be utilized as the radiating elements of a phased array and that they preserve the phase of frequencies which they multiply.

The primary cost driver in the development and production of an electronically scanned phased array has always been the phase control devices (phase shifters) required. For large scan angles and electrically large apertures, the number of phase shifters becomes enormous. This is true because the required element spacing is approximately $\lambda_o/2$ in both planes and a phase shifter is required behind each element with the required number of phase shifters given by Stangel's theorem as discussed earlier; i.e., number of phase shifters and elements is defined by Gain/Scan volume.

It has long been known that the phase and amplitude information required to steer the beam of a planar array, or an array distributed on a singly curved surface, consists of the superposition of two continuous, orthogonal functions. For an array in the (X,Y) Plane, the required phase functions are $\phi(X)$ and $\phi(Y)$. To this point, however, it has been necessary to implement a phase control device at each element in order to achieve the proper superposition for electronic scanning or null steering.

The need exists for electronically scanned phased array systems capable of operating at millimeter wavelength ferquencies and for small, low cost phased array systems.

SUMMARY OF THE INVENTION

Application of the present scanning method and apparatus to electronically scanned phased array antennas offers the potential for large improvements in performance over existing technology. The performance improvements take several forms and literally are measured in orders of magnitude. First, there is a large reduction in cost, complexity, weight, and volume involved in implementation of an electronically scanned phased array. Second, there are reduced $I^2R$ losses, due to fewer phase control networks. Third, inherent broadband operation becomes available in large or small arrays. Additionally, the present invention provides the ability to build electronically scanned phased arrays up through 95 GHz using existing technologies, while making the scanned phased arrays affordable and manageable.

In addition, the reduced number of controls, complexity, and expense, along with increased bandwith, render the use of phased arrays practical for applications hitherto considered unfeasible, and open the possibility for applications, such as hollographic RCS measurement in reduced cost, near field environments and hollographic image projection of decoys or cancellation singals.

Many of the problems attendant on development of active apertures are vastly reduced by application of the system of the present invention.

The present system allows satisfaction of Stangel's thereom using $2\sqrt{M}$ phase control elements operating at less than one-half the system operating frequency.

The present invention provides systems in which the heterodyne process is used to provide the superposition of orthogonal phase functions $\phi(X)$ and $\phi(Y)$ and to provide area distribution phase controls which satisfy Stangel's Theorem with at least an order of magnitude fewer controls than were previously necessary.

The present system allows satisfaction of the theorem by implementing the necessary area phase control function through the superposition of orthogonal phase functions via a distributed mixing process.

The present system described herein, combined with active aperture techniques, provides the proper superposition and thereby drastically reduces the required controls, circuit complexity, antenna volume, and weight, without sacrificing performance.

The preferred implementation uses single ended mixers with low cost mixer diodes and provides harmonic mixing as well as fundamental mixing. Spurious suppression is inherent in the distributed mix approach, and it offers the potential for improved noise performance. These devices are broad band and low in conversion loss, and consist of one diode each, with no supporting network. The phase shifters which they replace are inherently complex and relatively narrow band devices. In addition, the technique is inherently amenable to low cost production techniques.

Travelling wave array implementation of a two-plane scanning array is implemented via the present system which provides for the superposition of two orthogonal phase and amplitude functions. In a planar array or even an array conformed to a singly (cylindrical) curved surface, the scan function actually consists of the superposition of two independent phase functions $\phi(X)$ and $\phi(Y)$. When the elements of the array are replaced by mixers, and the distribution network implemented at LO and IF frequencies, the number of phase shifters required is reduced from $M \times N$ to $M+N$, and lower frequency technology is used.

Because of the vast reduction in the required number of phase shifters, the electronically scanned phased array using "2N Scanning" now becomes affordable and cost competitive with mechanically scanned antenna systems. In addition, significant improvements in complexity, performance, weight and volume of occupation can be achieved with the proposed approach. This type of phased array can now be built at much higher frequencies than once considered possible, since the phase shifter technology required is at the local oscillation (LO) distribution network frequency, and harmonic mixing can also be employed if necessary.

This invention provides methods and apparatus for "2N Scanning" systems as applied to electronically scanned phased arrays and indicates areas of application which are opened by their utilization.

A preferred phased array scanning system superimposes two orthogonal phase functions and generates a two-dimensional area function, while using only the phase shifter complement required for the sum of the two functions.

The preferred system uses a heterodyne process to provide the superposition of orthogonal phase functions $\phi(X)$ and $\phi(Y)$, for providing area distribution phase controls with a reduced number of controls.

The system implements the necessary area phase control function through superposition of orthogonal phase functions via a distributed mixing process.

A preferred phased array system has a hybrid, a transmitter connected to the hybrid, a receiver connected to the hybrid, a receiver/transmitter IF distribution network connected to the hybrid and M phase shifters connected to the receiver/transmitter IF distribution network.

A local oscillator distribution network is connected to a local oscillator. N phase shifters are connected to the local oscillator distribution network. An orthogonal array has $M \times N$ transmitting/receiving means. Each of the means is connected to one of the M phase shifters and to one of the N phase shifters. Preferably, the means comprise mixers; the preferred means are mixing diodes.

In one preferred embodiment, the means further have $M \times N$ antennas severally connected to the mixing diodes.

In a preferred embodiment, transmitting/receiving means further comprise diodes having first and second arms. First and second microcoaxial cables are connected to the first and second arms, and means connect each first and second coaxial cable to lines from one of the M phase shifters and one of the N phase shifters, respectively.

A preferred phased array system has plural dielectric layers. A first plurality of parallel microstrip or stripline conductors extend between the layers. A second plurality of microstrip conductors extends on one side of the layers. A plurality of diodes is mounted on an opposite side of the layers. A plurality of first relatively short coaxial lines is individually connected to each diode and to the first plurality of microstrips. A second plurality of longer coaxial lines is connected individually to each diode and to the second plurality of microstrip conductors.

The preferred system further has a first plurality of phase shifters connected individually to the first plurality of microstrip conductors and a second plurality of phase shifters individually connected to the second plurality of microstrip conductors.

Preferably, the system has an IF distribution network connected to one plurality of phase shifters and a local oscillator distribution network connected to the other plurality of phase shifters.

A local oscillator is connected to the local oscillator distribution network, and a hybrid is connected to the IF distribution network. A receiver and/or a transmitter are connected to the hybrid.

These and other further objects and features of the invention are apparent in the above and ongoing disclosure which includes the specification, the claims and the drawings.

DETAILED DESCRIPTION OF THE DRAWINGS

Figure 1:
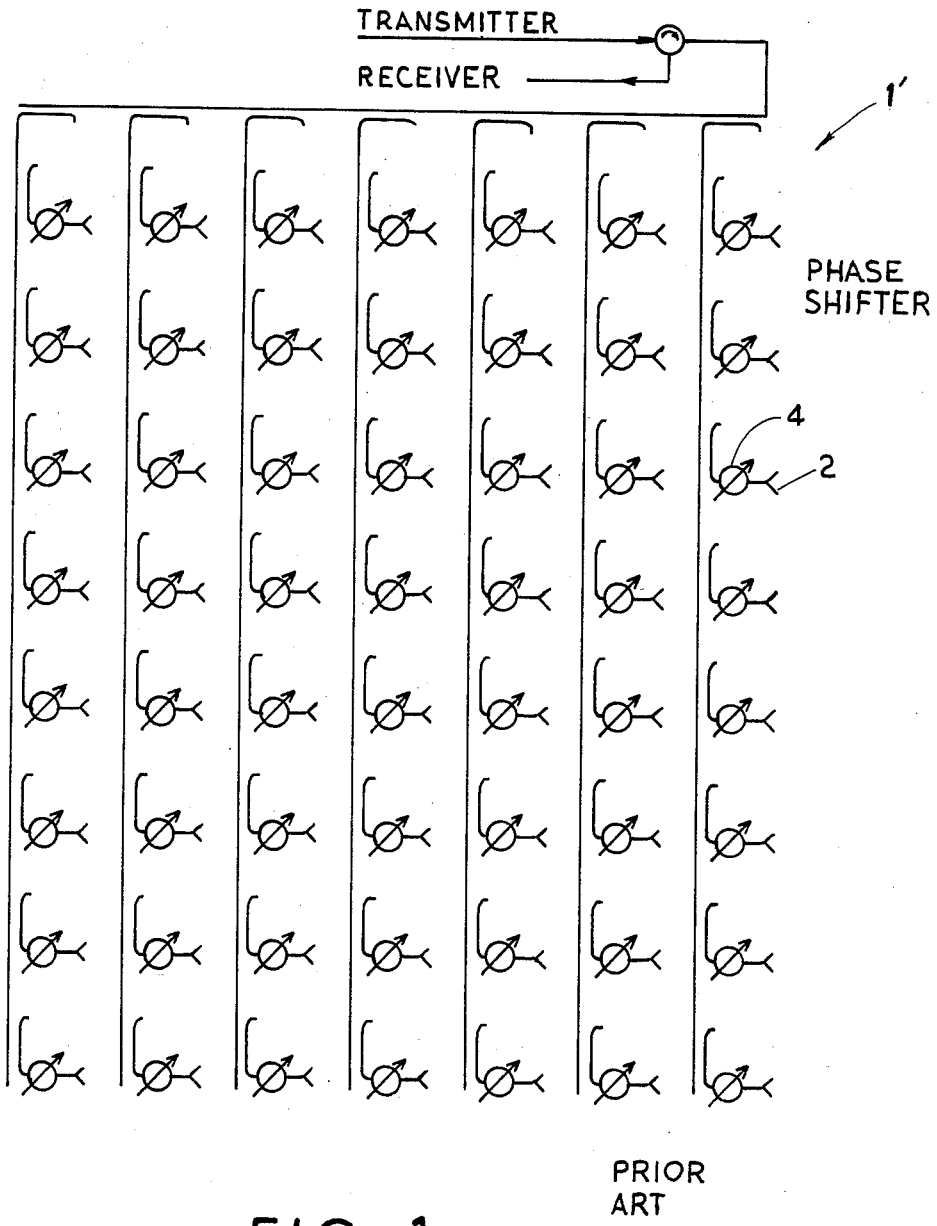
FIG. 1 shows a conventional $M \times N$ phased array using $M \times N$ phase shifters to implement a two-plane scan.

The classical concept of an electronically scanned phased array 1' is depicted in FIG. 1. This particular example is chosen for illustrative purposes only; many other forms of distribution network are possible. What follows is most easily understood in terms of the travelling wave distribution form shown, and applies to all arrays, regardless of the distribution network utilized. As can be seen, each and every radiating element 2 has an individual phase shifter 4. The achievement of two plane scan with a conventional $N \times N$ element array requires $N^2$ phase shifters. More generally, an $M \times N$ array requires $M \times N$ phase shifters.

Figure 2:
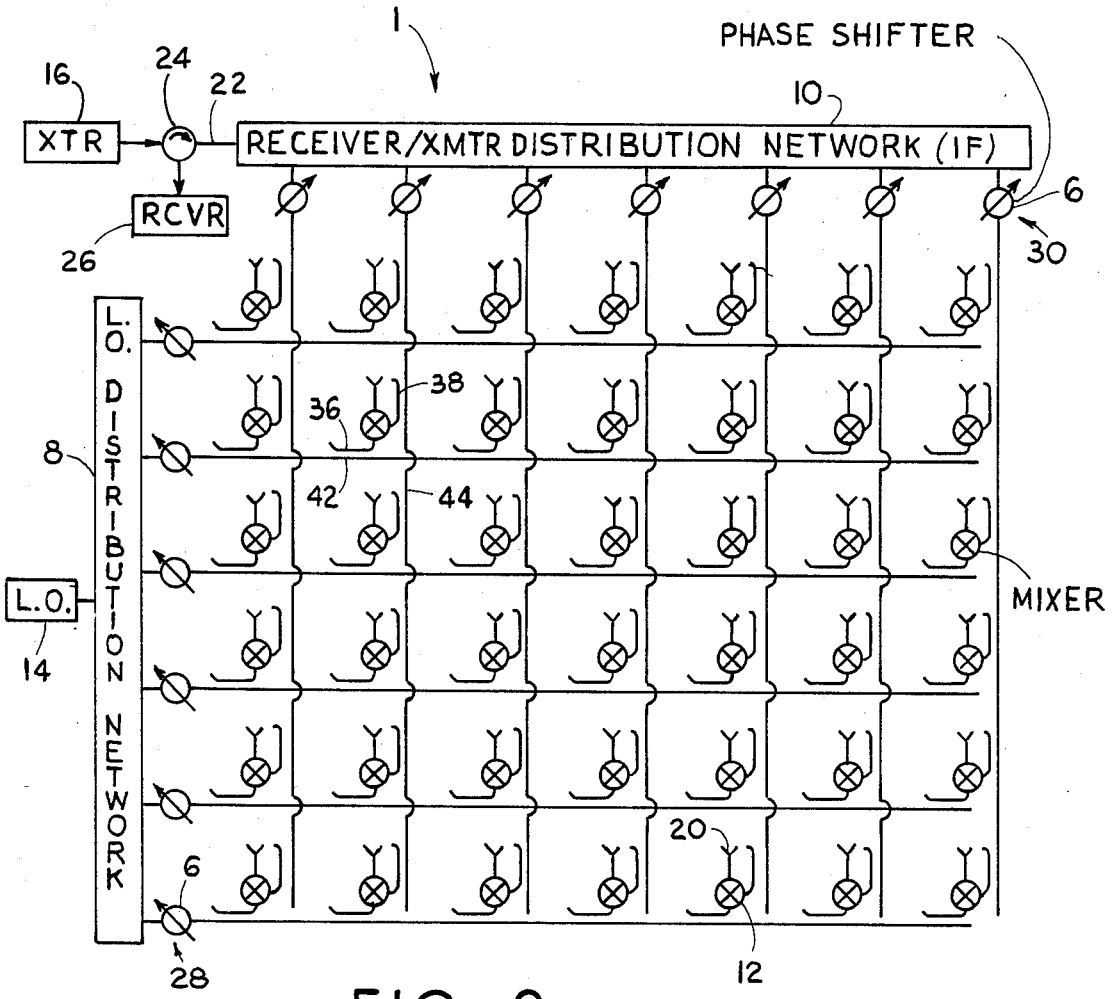
FIG. 2 is a schematic representation of the present invention in which an $M \times N$ phased array uses $M+N$ phase shifters for a two-plane scan.

FIG. 2 shows the innovative present "2N Scanning" system 1. Close inspection reveals that this same $M \times N$ element array, capable of 2 plane scan, now contains $M+N$ phase shifters 6 imbedded in the distribution networks 8 and 10. If the array were square, rather than rectangular, M+N reduces to 2N; hence the name "2N Scanning System".

Each radiating element 2 has now been replaced by a mixer diode 12 fed by the local oscillator 14 and transmitter 16 sources, both of which are at IF. The mixer diode may radiate directly into space or into some other radiating medium 20, i.e., slot, waveguide element, etc. In a passive or receive only mode, the received signal is available at the receiver/transmitter distribution port 22 and circulator 24 and receiver 26, with the transmitter source 16 eliminated. The distribution networks 8 and 10 are composed of printed lines, stripline, microstrip, etc., containing the directional couplers that feed each element of the array. Conductors 42 and 44 from distribution networks are coupled to short transmission lines 36 and 38.

Note that the single path encounters the same number of noise contributions as a conventional radar, but that there is now available an improved noise figure for the following reasons.

Phase shifter contributions to noise are reduced because they are at lower frequency and can be made less lossy.

Mixer contributions are less because of single ended mix process. There is no necessity for balanced, double balanced, or image rejection mixing, since the distributed mix process has inherent spurious rejection.

Distribution network contributions are less because the network is at IF where it can be made less lossy and subtends much less electrical length.

To demonstrate mathematically that the heterodyne, or mix, process does indeed preserve the phase as desired, consider the following:

Define a modulated transmit signal to be of the form:

$$T=x(t)\cos(W_1t+\phi_1)$$

And a Local Oscillator (LO) as a continuous wave (CW) signal of the form:

$$LO=\cos(W_2t+\phi_2)$$

Multiplying these two signals together in the mix process results in $$\frac{x(t)}{2}\,(\cos[(W_1-W_2)t+(\phi_1-\phi_2)]+$$

Difference Component (Use on Receive)

$$\cos[(W_1+W_2)t+(\phi_1+\phi_2])$$

Sum Component (Use on Transmit)

where by inspection it can be seen that the transmitted frequency is at the desired sum value of $(W_1+W_2)$ and that the phase of the two source signals (LO and transmitter) is preserved during the mix process. Following the same course of analysis as above, operation of the array can be shown to preserve frequency and phase in the receive mode.

Phase control for the array 2 is provided by the rows 28 and 30 of phase shifters 6 at the output of the distribution networks 8 and 10; one row providing azimuth plane scan control, the other elevation. This is a uniqueness of the present system. It provides for the superposition of two orthogonal phase functions to generate a two-dimensional area function while using only the phase shifter complement required for the sum of the two functions rather than their product, as assumed by Stangel's Theorem.

Since the phase shifters are at the LO and IF frequencies, there is a larger phase shifter technology base from which to choose. For example, a Ka-band phased array can use diode phase shifters instead of the ferrite devices normally required. Likewise, use of harmonic mixing allows the design and fabrication of a Q-band array using the same phase shifter technologies.

Another advantage of the proposed technology is vastly reduced $I^2R$ and dispersion losses in the distribution network. This is due in part to decreased frequencies of operation and shorter electrical line lengths. Historically, except for space fed systems, distribution network $I^2R$ losses have been one of several reasons high frequency electronically scanned phased arrays have not been implemented more often. In addition, dispersion effects have resulted in narrow band systems when arrays have been built, and this accounts for the difficulties in achieving matched line lengths. The present system minimizes both of these phenomena.

At microwave frequencies below 18 GHz, dispersion is less of a problem, provided the appropriate steps are taken during design. The present distribution network employs printed circuit technologies, i.e., microstrip, stripline, etc., where broad bandwidths are readily obtained. In stripline, for example, a single section quarter wavelength long directional coupler may possess a bandwidth of an octave. This, of course, does entail some variation in the coupling value over frequency. For example, 1.2 dB on a 10 dB coupler over 66% bandwidth and 1.0 dB on a 6 dB coupler over the same bandwidth may be typical, Thus, the rate of change with frequency in the coupling values of directional couplers appears to be quite similar for the most commonly used coupling values, and the magnitudes of variation are trivial to the mix process. As a result, while the energy coupled to the individual elements varies slightly over frequency, the relative energy between elements remains very nearly constant; i.e., the aperture distribution remains constant.

Figure 3:
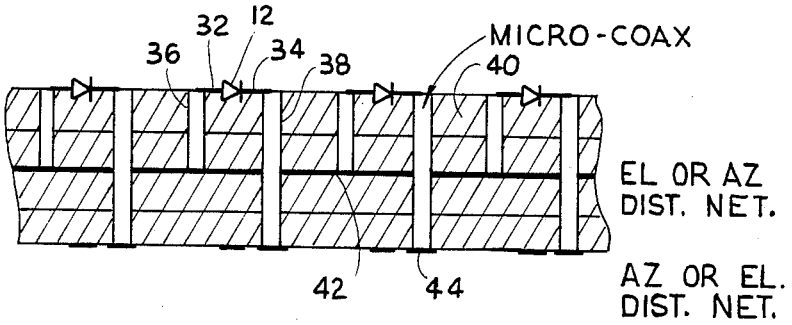
FIG. 3 is a schematic detail of one embodiment of the phased array showing a side view partially in cross-section of diodes and small diameter coaxial cables running between dielectric layers to the elevation or azimuth microstrip distribution networks.

An arrangement employing both microstrip and stripline is shown in FIG. 3. In the example implementation, energy is brought to the arms 32, 34 of the mixer diodes 12 via short lengths 36 and 38 of small diameter coaxial cable running between the dielectric layers 40 from conductors 42 and 44 from respective groups 28 and 30 of phase shifters 6 associated with the distribution networks 8 and 10. The mixer diodes 12 are caused to radiate into slots or other frequency selective elements for suppression of LO leakage and/or to support harmonic mixing.

The anticipated benefits derived from implementation of the present "2N Scanning" system include the following: reduced phase shifter count, employment of mature phase shifter technologies at IF frequencies, reduced weight and volume of occupation, improved performance due to lower $I^2R$ and dispersion losses, implementation at higher frequencies, and reduced cost.

While the invention has been described with reference to specific embodiments, modifications and variations may be constructed without departing from the scope of the following claims.

That which is claimed is:

1. A phased array system having a circulator, a transmitter connected to the circulator, a receiver connected to the circulator, a receiver/transmitter IF distribution network connected to the circulator, M phase shifters connected to the receiver/transmitter IF distribution network, a local oscillator, a local oscillator distribution network connected to the local oscillator, N phase shifters connected to the local oscillator distribution network, an orthogonal array of M×N transmitting-/receiving means, each of the receiving means comprising an IF mixing diode connected to one of the M phase shifters and to one of the N phase shifters.

2. The system of claim 1 wherein the means further comprise M×N antennas individually connected to the mixing diodes.

3. The system of claim 1 wherein the diodes further comprise diodes having first and second arms, first and second microcoaxial cables connected to the first and second arms, and means for connecting each first and second coaxial cable to one of the M phase shifters and to one of the N phase shifters, respectively.

4. A phased array system having plural dielectric layers, a first plurality of parallel microstrip conductors extending between the layers, a second plurality of microstrip of diodes mounted on an opposite side of the layers, a plurality of first relatively short coaxial cables severally connected to each diode and to the first plurality of microstrip conductors, and a second plurality of relatively long coaxial cables connected individually to each diode and to the second plurality of microstrip conductors, a first plurality of phase shifters connected individually to the first plurality of microstrip conductors and a second plurality of phase shifters individually connected to the second plurality of microstrip conductors, and an IF distribution network connected to one of the plurality of phase shifters and a local oscillator distribution network connected to the other plurality of phase shifters.

5. The system of claim 4 further comprising a local oscillator connected to the local oscillator distribution network and a circulator connected to the IF distribution network and a receiver and a transmitter connected to the circulator.

6. A phased array scanning system having first and second distribution networks and transmission lines, signal means connected to the first network, an oscillator connected to the second network, a first plurality of phase shifters individually connected to the first network, a first like plurality of transmission lines connected to the first plurality of phase shifters, a second plurality of phase shifters individually connected to the second network, a second like plurality of transmission lines connected to the second plurality of phase shifters, and plural IF mixers and antenna means individually coupled to the first and second transmission lines.

7. An integrated phased array radar transmitter/-receiver system comprising a transmitter operating at IF, a circulator connected to the transmitter, a receiver operating at IF, the receiver being connected to the circulator, a transmitter/receiver IF distribution network connected to the circulator, M phase shifters connected individually to the transmitter/receiver IF distribution network, M transmission lines connected individually to the M phase shifters, a local oscillator, a local oscillator distribution network connected to the local oscillator, N phase shifters connected to the local oscillator network, N transmission lines individually connected to the N shase shifters, M×N IF to RF/RF to IF mixers connected individually to the M and N transmission lines, wherein the mixers operate as antennas and as distributed receiver mixers and wherein the transmitter, receiver, circulator, transmitter/receiver IF distribution network, M phase shifters and M transmission lines operate at IF.

8. An integrated phased array radar transmitter/-receiver system comprising a transmitting or receiving means operating at IF, an IF distribution network connected to the means, M phase shifters connected individually to the IF distribution network, M transmission lines connected individually to the M phase shifters, a local oscillator, a local oscillator distribution network connected to the local oscillator, N phase shifters connected to the local oscillator network, N transmission lines individually connected to the N phase shifters, M×N IF to RF or RF to IF mixers connected individually to the M and N transmission lines, wherein the said means, IF distribution network, M phase shifters and M transmission lines operate at IF.

9. An integrated phased array radar receiver system comprising: a local oscillator (LO); a LO network connected to the oscillator; N phase shifters connected to the LO network, M×N IF mixers, M of the IF mixers connected to each of the N phase shifters; M×N RF antenna means, each antenna means connected individually to one IF mixer, for receiving an RF signal and mixing that received RF signal with a phase-shifted LO signal and producing a unique IF signal; M phase shifters connected to the M×N IF mixers, each of the M phase shifters being connected to N IF mixers, for providing N unique IF signals to each of the M phase shifters; an IF network connected to the M phase shifters; and a receiver connected to the IF network whereby the receiver receives M×N phases shifted IF signals; wherein M and N are whole numbers.

10. The system of claim 9 further comprising a circulator connected between the IF network and the receiver and an IF signal transmitter connected to the circulator for providing IF signals to the IF network and via the M phase shifters to the M×N IF mixers, whereby the IF mixers mix the phase-shifted IF signals and phase-shifted LO signals and provide RF signals to the antenna means.

11. An integrated phased array radar transmitter/-receiver system comprising transmitting an IF signal, distributing the IF signal to M phase shifters, supplying IF signals with shifted phase to M transmission lines, generating a local oscillator LO frequency signal, distributing the local oscillator signal to N phase shifters, supplying LO signal with shifted phase to N transmission lines, supplying phase-shifted LO frequency signal and phase-shifted IF signal to M×N mixers, mising IF and LO frequency signals in the M×N mixers, supplying RF transmit signals from the M×N mixers receiving RF signals at the M×N mixers, mixing the received RF signals and the LO frequency signals in the M×N mixers, supplying IF signals from the M×N mixers to the M distribution lines, shifting phase of IF signals from the M transmission lines receiving phase-shifted IF signals from the M transmission lines in the transmitter/receiver IF distribution network and supplying IF signals from the transmitter/receiver distribution network to a receiver.

12. The system of claim 11 further comprising providing IF signals from a transmitter to the IF network, providing IF signals to the M phase shifters, phase shifting the transmitted IF signals as M phase-shifted IF signals and providing each phase-shifted IF signal to N of the M×N mixers, mixing the phase-shifted IF signals and the phase-shifted LO signals and producing RF signals from the mixers.

13. An integrated phased array receiver system comprising providing a local oscillator (LO) signal, phase shifting the LO signal with N phase shifters, providing phase shifted (LO) signals to N rows of M×N IF mixers, receiving RF signals in the M×N IF mixers, mixing the received RF signals with the LO signals in the M×N mixers and producing M×N IF signals, providing the IF signals to M phase shifters, phase shifting the IF signals, providing the phase-shifted IF signals to an IF network and providing the IF signals from the IF network to a receiver.

* * * * *